US010077906B2

(12) United States Patent
Gayle et al.

(10) Patent No.: US 10,077,906 B2
(45) Date of Patent: Sep. 18, 2018

(54) HOME COOKING APPLIANCE WITH A SIDE SWING OVEN DOOR HAVING A FRICTION HINGE

(71) Applicant: BSH Home Appliances Corporation, Irvine, CA (US)

(72) Inventors: James Gayle, New Bern, NC (US); Joseph Geiger, Trent Woods, NC (US); George May, New Bern, NC (US); Felix Rueter, Munich (DE)

(73) Assignee: BSH Home Appliances Corporation, Irvine, CA (US)

( * ) Notice: Subject to any disclaimer, the term of this patent is extended or adjusted under 35 U.S.C. 154(b) by 41 days.

(21) Appl. No.: 15/446,047

(22) Filed: Mar. 1, 2017

(65) Prior Publication Data

US 2017/0176020 A1 Jun. 22, 2017

Related U.S. Application Data

(62) Division of application No. 14/029,935, filed on Sep. 18, 2013, now Pat. No. 9,631,819.

(51) Int. Cl.

| | |
|---|---|
| ***E05D 11/08*** | (2006.01) |
| ***F24C 15/02*** | (2006.01) |
| *E05C 1/08* | (2006.01) |

(52) U.S. Cl.

CPC ..... *F24C 15/023* (2013.01); *E05C 1/08* (2013.01); *E05D 11/08* (2013.01); *F24C 15/02* (2013.01)

(58) Field of Classification Search

CPC ..... F24C 15/02; F24C 15/023; E05D 11/08; E05F 1/08

USPC ..... 126/194, 190, 197; 16/334, 286

See application file for complete search history.

(56) References Cited

U.S. PATENT DOCUMENTS

| | | | | |
|---|---|---|---|---|
| 2,707,225 | A | 4/1955 | Pearce | |
| 3,736,398 | A | 5/1973 | Jarvis | |
| 4,453,065 | A | 6/1984 | Taylor, Jr. et al. | |
| 4,490,884 | A * | 1/1985 | Vickers | E05D 11/082 16/338 |
| 4,788,748 | A * | 12/1988 | Bizek | E05D 5/10 16/308 |
| 6,233,785 | B1 * | 5/2001 | Tanahashi | G06F 1/1616 16/273 |
| 7,111,363 | B2 | 9/2006 | Lee et al. | |
| 7,814,897 | B2 | 10/2010 | Larsen | |
| 8,201,304 | B2 | 6/2012 | Streurer et al. | |
| 8,336,535 | B2 | 12/2012 | Larsen et al. | |
| 8,677,565 | B2 * | 3/2014 | Vanini | A47L 15/4261 16/286 |

(Continued)

*Primary Examiner* — Gregory Huson
*Assistant Examiner* — Nikhil Mashruwala
(74) *Attorney, Agent, or Firm* — Michael E. Tschupp; Andre Pallapies; Brandon G. Braun

(57) ABSTRACT

A home cooking appliance with a side swing door is provided. The home cooking appliance includes a housing having a cooking cavity and a side swing door movable about at least one hinge between a closed position and an open position to provide access to the cooking cavity, wherein the at least one hinge includes a friction hinge configured to impede rotational motion of the side swing door, wherein the friction hinge is a variable torque friction hinge configured to provide a variable torque throughout at least a part of a range of motion in at least one of an opening direction and a closing direction of the of the side swing door.

5 Claims, 10 Drawing Sheets

(56) References Cited

U.S. PATENT DOCUMENTS

| | | | | |
|---|---|---|---|---|
| 9,181,737 | B1 * | 11/2015 | Kadus | E05D 11/0054 |
| 2005/0190533 | A1 * | 9/2005 | Hultzman | E05D 11/08<br>361/679.21 |
| 2008/0201907 | A1 | 8/2008 | Vanini | |
| 2009/0145031 | A1 | 6/2009 | Collene | |
| 2010/0146734 | A1 | 6/2010 | Munson et al. | |
| 2013/0205543 | A1 * | 8/2013 | Chen | E05D 11/087<br>16/301 |

* cited by examiner

HOME COOKING APPLIANCE WITH A SIDE SWING OVEN DOOR HAVING A FRICTION HINGE

CROSS-REFERENCE TO RELATED APPLICATIONS

The present application is a divisional application of U.S. patent application Ser. No. 14/029,935, filed on Sep. 18, 2013, the contents of which are herein incorporated by reference in their entirety.

FIELD OF THE INVENTION

The present invention is directed to a home cooking appliance with a side swing door, and more particularly, to a home cooking appliance with a side swing door having a friction hinge.

BACKGROUND OF THE INVENTION

A home cooking appliance, such as a freestanding oven or built-in oven, commonly includes a door coupled to the appliance housing by two or more hinges such that the door can move between a closed position for sealing items to be cooked within the cooking cavity and an open position for placing items to be cooked into the cooking cavity or removing items from the cooking cavity.

One type of home cooking appliance commonly includes a horizontally hinged door that swings vertically about the horizontal axis hinges such that, when the oven door is in the open position, the door extends horizontally outward from a lower end of the oven in front of the cooking cavity. For such a door that swings vertically and outward over the lower part of the oven, the risk of inadvertent and premature closure of such a door from normal interaction of common activities around the appliance are at a minimal. A variety of types of hinges are employed in a horizontally hinged door that swings vertically to control its motion as well as provide a means of counter-balance, though the use of mechanical springs, etc, such that the door will maintain its position at a variety of angles between the fully open and fully closed positions. The design of a door in this conventional arrangement is mandated per nationally recognized safety regulations to not close on its own without the assistance of a force, external to that of the door, directed upon the door such that it rotates up towards the closed position. As a result, the risk of an individual using the cooking appliance, with respect to receiving injury, burn and otherwise, is held to a minimum.

Another type of home cooking appliance may include a side swing door that is vertically hinged and swings laterally about vertical axis hinges such that, when the oven door is in the open position, the door extends vertically outward from one side of the oven such that the door is positioned to the side of the cooking cavity. Since the door swings laterally away from the cooking cavity and is positioned alongside the cooking cavity when the door is in an open position, the operation of the door may be affected by, or interfered with by, adjacent cabinetry or appliances, or the door may interfere with the operation of one or more doors of such adjacent cabinetry or appliances. In addition, the door commonly is configured to be flush with any adjacent cabinetry or appliances. Due to the limited space available on the appliance housing, the conventional means for securing a vertical swing door to the appliance are not suitable for a side swing door and only a limited amount of different types of hinges can be used to secure the door without the door interfering with adjacent cabinetry or appliance. In operation, the vertically placed hinges provide a pivot point about which the door can rotate. The pivot point can be a fixed pivot point or varying pivot point using multiple linkages. In order to provide a smooth motion of the door, which exhibits a high quality tactile feel and meets a user's expectations of a high quality cooking appliance, the hinges that support the weight of the door must provide a smooth and quiet operation. As a result, the conventional side swing door commonly utilizes a robust, low friction hinge to provide such a smooth and quiet operation.

However, as explained in greater detail below, the present invention recognizes that a low friction hinge on a side swing oven door can increase a risk of unintended or unimpeded movement of the oven door, particularly in instances in which the home appliance is not installed perfectly level.

SUMMARY OF THE INVENTION

The present invention, as illustrated for example in the exemplary embodiments, provides a home cooking appliance comprising a housing having a cooking cavity, and a side swing door movable about at least one hinge between a closed position and an open position to provide access to the cooking cavity, wherein the at least one hinge includes a friction hinge configured to impede rotational motion of the side swing door.

In this way, the present invention provides a home cooking appliance with a side swing door that can inhibit or prevent unintended or unimpeded movement of the oven door, thereby enabling a user to easily position the side swing door of the home cooking appliance and hold the side swing door securely at any desired angle, including for example a fully opened position, a fully closed position, or any position in between, and thereby providing an extra level of protection to the user of the appliance from inadvertently being contacted by the door due to unimpeded rotation set into motion by gravity or other external forces. More particularly, a home cooking appliance with a side swing door can include a friction hinge such that a hot oven door can be prevented from rebounding off adjacent furniture or from continuing to move in the event of an accidental push from another user, thereby preventing or limiting a risk of a user being contacted by a hot surface of the oven door and improving the safety of the side swing door. The friction hinge enables a user to open and release the side swing door at any angle and can slow or stop the momentum of the side swing door due to the opposing friction/torque provided by the friction hinge. As a result, no detents are required and the tactile perception or feel of the door by the user can be enhanced, while also improving the safety of the side swing door.

For further clarification and background of the present invention, various aspects and considerations of a home cooking appliance having a side swing door, which have been recognized by the present invention, will first be described. As explained above, with a side swing door, the door swings laterally away from the cooking cavity and is positioned alongside the cooking cavity when the door is in an open position. A conventional side swing door arrangement commonly must utilize a robust, low friction hinge to provide a smooth and quiet operation, which exhibits a high quality tactile feel and meets a user's expectations of a high quality cooking appliance. The present invention recognizes, however, that such a low friction hinge on a side swing oven door may increase a risk of unintended or unimpeded movement of the oven door, particularly in instances in which the home appliance is not installed perfectly level or an external force is applied to the door, such as a user inadvertently bumping into the door.

For example, if a home cooking appliance having a side swing door is installed such that the hinges are aligned and such that the rotating axis of the door is sufficiently vertical, then the door ideally will not be suspect to gravitational forces and will remain motionless until other external forces are applied to the door causing it to rotate. However, if an external force is applied to the side swing door either intentionally or inadvertently, then the movement of the side swing door will not be impeded, which may result in a risk of the side swing door contacting adjacent cabinetry or a user coming into contact with the side swing door, such as a heated surface of the side swing door. That is, if a cooking appliance having a side swing door is installed as intended, such that the pivot axis is sufficiently vertical to deny the force of gravity to impart rotational motion, the door may become an obstacle for other persons involved in other normal activities around such a cooking appliance when the door is opened to any angle, thereby requiring the user to be vigilant and cautious in order to avoid contact with such a door. Moreover, without an additional mechanical means to resist rotation, the momentum of the door set into motion may cause the door to rotate on its high quality hinges until the door closes completely or comes into contact with something in a path of the door.

In another example, if a home cooking appliance having a side swing door is installed such that the hinges are not aligned or such that the rotating axis of the door is not sufficiently vertical, then the door may be suspect to gravitational forces and may not remain motionless when the door is not restrained by the user or by any other mechanical means. Particularly, if the hinges are not aligned or such that the rotating axis of the door is not sufficiently vertical, then the force of gravity to overcome the low intrinsic frictional forces of the high quality hinges and propel the door towards open or closed until the center of gravity of the door finds the lowest point in the plane of rotation or until the rotation of the door is impeded by reaching the fully closed position, impeded by reaching a mechanically limited maximum open position by design, or by contacting an outside object such as an adjacent cabinet or appliance, or any other object that happens to be in the rotational path.

For at least these reasons, the present invention recognizes that the conventional home appliance with a side swing door having a low friction hinge may increase a risk of the side swing door unexpectedly swinging or continuing to move in a direction toward adjacent cabinetry or adjacent appliances, or toward a user, which may increase a risk of interference with or damage to adjacent cabinetry or adjacent appliances, or a risk of injury to a user, for example, resulting from contact with the side swing door, such as a physical injury from inadvertent contact with the door, or from a burn from contact with a hot inner surface of the cooking appliance door. As a result, the present invention recognizes that, rather than providing a low friction hinge according to the teachings of the prior art, there is a need to provide means for impeding or resisting unintentional rotation of the side swing door by slowing and ultimately stopping the rotation of the side swing door of the home cooking appliance as smoothly and as quickly as possible. However, the present invention recognizes that various forms of dampening devices, such as hydraulic and electromagnetic dampening devices, cannot provide the necessary tactile means for smoothly dampening and stopping the motion of the side swing door using mechanical components only and without becoming too great of a resistive force to motion. The hydraulic dampers or electromagnetic dampers cannot create the necessary "brake" holding force while maintaining a reasonable amount of force on the resistance of motion.

Furthermore, because of the limitations on space and the limitations on types of suitable hinges and dampening devices that can be used in a side swing door of a home cooking appliance, many other means of dampening the rotation of the door, such as means external to the hinge location, may obstruct the cooling airflow through the door, or hinder the ability to insulate the cooking cavity of the home cooking appliance by occupying same space that must be utilized for placement of insulating materials.

The exemplary embodiments of the present invention solve these and other problems by providing, for example, a home cooking appliance comprising a housing having a cooking cavity, and a side swing door movable about at least one hinge between a closed position and an open position to provide access to the cooking cavity, wherein the at least one hinge includes a friction hinge configured to impede rotational motion of the side swing door. In this way, the present invention provides a home cooking appliance with a side swing door that can inhibit or prevent unintended or unimpeded movement of the oven door, thereby enabling a user to easily and precisely position the side swing door of the home cooking appliance and hold the side swing door securely at any desired angle, including for example a fully opened position, a fully closed position, or any position in between, and thereby enabling the side swing door to be positioned precisely by the user with minimal or no movement after the user ceases to apply force on the door. Accordingly, the present invention can provide an extra level of protection to the user of the appliance from inadvertently being contacted by the door due to unimpeded rotation set into motion by gravity or other external forces, thereby improving the operation and safety of a home cooking appliance having a side swing door.

For purposes of this disclosure, a friction hinge is defined as a hinge device with torque between two parts of the hinge. The exemplary friction hinge is not limited to any particular type of friction hinge, and can have a wide variety of sizes, materials, and torque ranges to satisfy the requirements for the particular side swing door of the home cooking appliance. The friction hinge device can include, for example, a fixed, common axis or a plurality of axes using multiple linkages. For example, the friction hinge can be an integral friction based dampening hinge that provides a braking mechanism to the vertically hinged side swing door of the home cooking appliance, thereby improving protection for the user. The friction hinge can be an integral friction based dampening hinge that provides a resistive force that can be tailored to or configured to have a specific tactile feel in opening and closing, thereby improving the user's perception of a quality feel of the home cooking appliance. The friction hinge can be a robust hinge component that is capable of supporting the weigh to the particular side swing door of the home cooking appliance while providing a smooth operating movement.

The exemplary home cooking appliance can include one or more friction hinges to impede rotational motion of the side swing door. For example, if the side swing door of the home cooking appliance has two hinges, one or both of the hinge locations can include a friction hinge. In another embodiment, one or more separate friction hinges can be provided in addition to the supporting hinges of the side swing door. In yet another embodiment, one or more friction hinges can be integrally formed with another type of hinge to support the side swing door while also impeding the motion of the side swing door and providing a desirable tactile feel to the operation of the side swing door.

The exemplary embodiments can include a friction hinge having, for example, various types of frictional materials or sliding contact materials used to create the friction resistance to motion, such as any combination of steel, plastic, ceramic, elastomer, etc. For example, the exemplary embodiments can include a friction hinge having, for example, various types of frictional materials such as spring steel clamps on a metal shaft, spring steel clamps on a ceramic shaft, various metal and plastic friction clips, and/or compressed elastomers, etc. The exemplary embodiments can include a friction hinge with or without a friction style lubricant.

If more than one friction hinge is provided on the side swing door, each friction hinge can have the same features and characteristics. However, in other embodiments, each of the friction hinges can have different features and characteristics, such as different torques, or be formed using one or more different materials.

The exemplary embodiments of the home cooking appliance can be configured such that the friction hinge fits within the limited available space inside the door frame, and particularly, within the limited available space inside the door frame at the particular hinge location. The exemplary embodiments of the home cooking appliance can be configured such that the components of the friction hinge are capable of withstanding elevated temperatures of a home cooking appliance, such as temperatures ranging from approximately 90° C.-100° C.

In an exemplary embodiment, the exemplary friction hinge can be configured to resist rotational motion and act as a braking mechanism to prevent the cooking appliance door, on an appliance that is not level, from rotating or continuing to rotate on its own, thereby reducing or preventing a risk of injury to a user of the home cooking appliance. The present invention recognizes that there exists a limitation to the degree in which the appliance can be installed out of level while still performing the braking function as intended, before the braking force becomes too great and obstructs functional usability of the side swing door of the home cooking appliance. One of ordinary skill in the art will recognize that the friction hinge can be configured or selected to provide a balance between these functions.

In an exemplary embodiment, the exemplary friction hinge can be configured to impede or resist rotational motion of the side swing door and act as a braking mechanism to quickly slow and stop a side swing door in an event that the side swing door has been inadvertently bumped or impacted by the user or another person performing common activities around the home cooking appliance.

In an exemplary embodiment, the friction hinge can include a constant torque friction hinge, which is defined as a friction hinge that provides constant torque throughout the entire range of motion.

In another exemplary embodiment, a home cooking appliance with a side swing door having a friction hinge can be configured to provide different resistive forces to rotation depending on a direction of rotation initiated by the user. For example, an exemplary friction hinge can be configured such that a resistance to rotation while opening the door (e.g., in a first direction) is less than a resistance to rotation when closing the door (e.g., in a second direction, which is opposite the first direction), or vice versa, depending upon the tactile experience that is intended to be perceived. An exemplary friction hinge can provide, for example, a differential torque with 100% of nominal torque in the first direction and 65% of nominal torque in the second (opposite) direction.

In another exemplary embodiment, the friction hinge can include a variable torque friction hinge, which is defined as a friction hinge that provides varying torque throughout the range of motion. For example, a dynamic torque of the hinge, which is defined as a resistance experienced during rotation of the hinge, can be configured to be different from (e.g., less than) a static torque of the hinge, which is the resistance required to start the rotation of the door about the friction hinge.

In another exemplary embodiment, the friction hinge can be configured to provide varying amounts of so-called spring back, which is defined as the amount of motion (in degrees) that results after a force applied to the side swing door to move the door is removed. In some instances, a user may perceive such movement of the side swing door as an undesirable "sloppy" operation of the door or as an indication of low quality, particularly in instances in which a greater amount of movement is permitted by the hinge. Thus, in another exemplary embodiment, the friction hinge can be configured to minimize or eliminate so-called spring back altogether, thereby providing a more precise positioning of the door with minimal or no additional movement after the user releases the door or ceases to apply force to the door, thereby improving the operation and safety of the side swing door.

In another exemplary embodiment, the friction hinge can be configured to provide varying amounts of so-called free play, which is defined as the amount of motion (in degrees) that the side swing door is permitted to move before a user perceives a torque at a given position of the hinge. In some instances, a user may perceive such movement of the side swing door as an undesirable "sloppy" operation of the door or as an indication of low quality, particularly in instances in which a greater amount of movement is permitted by the hinge. Thus, in another exemplary embodiment, the friction hinge can be configured to minimize or eliminate so-called free play altogether, thereby providing a more precise positioning of the door and an improved, and more responsive, tactile feel to the user when the user begins moving the side swing door, thereby improving the operation and safety of the side swing door.

In another exemplary embodiment, a home cooking appliance with a side swing door having an integral friction based dampening mechanism can be configured to additionally utilize gravitational assist or to utilize another additional device that provides mechanical assistance, such as for example springs, magnets, or another device, in order to provide a particular, tailored tactile force while minimizing or reducing a risk of injury to a user of the home cooking appliance. In other words, the tactile forces on the side swing door may be augmented or reduced by a combination of gravity assist or another mechanical means, while the friction hinge provides the primary function of impeding the motion of the side swing door. In another embodiment, a home cooking appliance with a side swing door can include one or more friction hinges that are integrally formed with another type of hinge that is configured to utilize gravitational assist or to utilize another additional device that provides mechanical assistance, such as for example springs, magnets, or another device, in order to support the side swing door while impeding the motion of the side swing door and providing a particular, tailored tactile force.

In an exemplary embodiment, the exemplary friction hinge can be configured to apply a predetermined amount of closing force and/or a predetermined amount of opening force. The predetermined amount of closing force can be equal to the predetermined amount of opening force, or the predetermined amount of closing force can be different from, or independent of, the predetermined amount of opening force. In this way, the present invention can provide a tailored tactile feel which may also maintain or improve a level of safety to the user of the home cooking appliance. Depending on the amount of closing force provided by the hinge, the present invention also may minimize an amount of latching force needed to secure the side swing door in a closed position, or eliminate the need to provide a latching mechanism altogether. The home cooking appliance with a side swing door can include one or more friction hinges that are integrally formed with another type of hinge that is configured to provide the predetermined amount of closing force and/or the predetermined amount of opening force, or the home cooking appliance can include one or more separate friction hinges along with one or more of another type of hinge that is configured to provide the predetermined amount of closing force and/or the predetermined amount of opening force.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
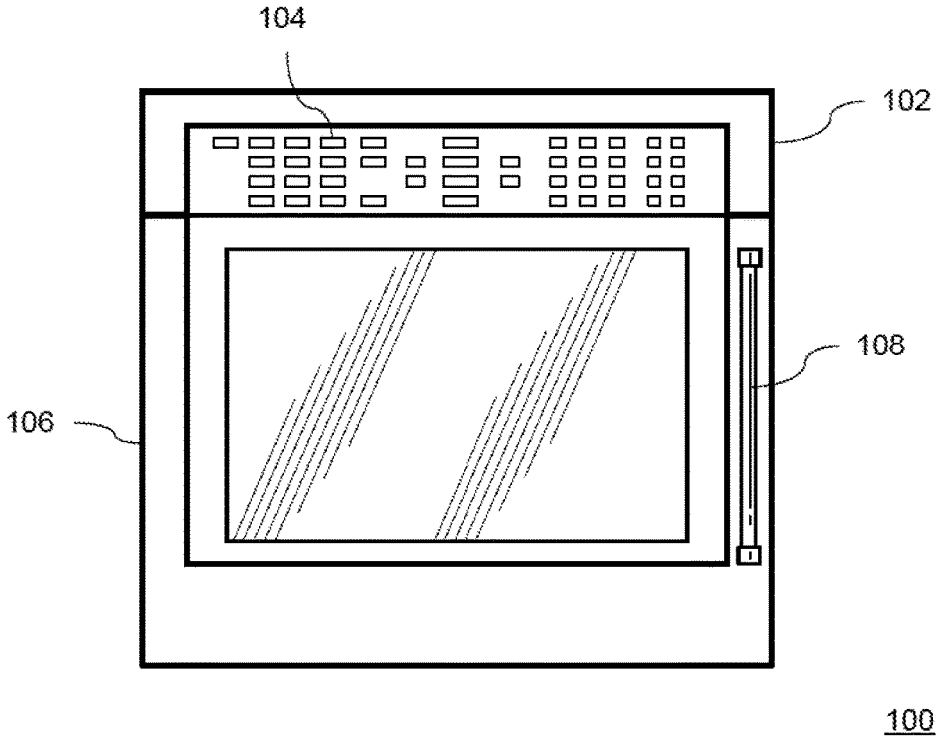
FIG. 1 is a front view of a home cooking appliance with a side swing door having an integral friction based dampening hinge, in which the side swing door is closed.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10 illustrate exemplary embodiments of a home cooking appliance with a side swing door having friction hinge, according to exemplary embodiments of the invention.

Figure 2:
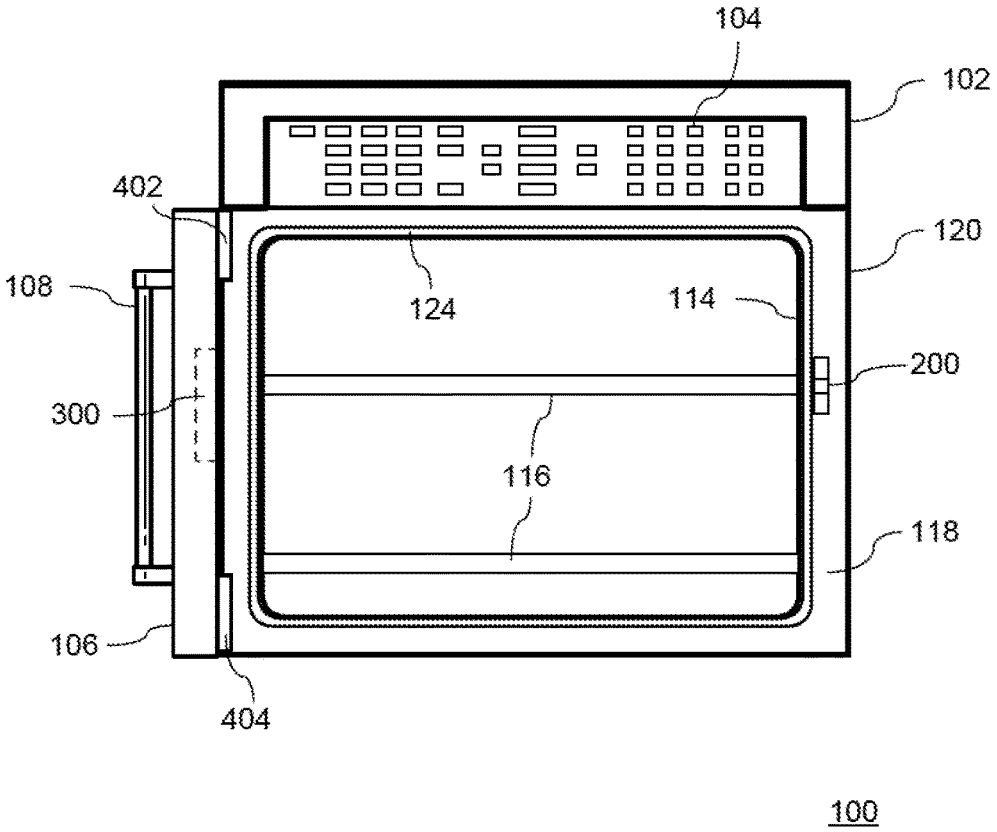
FIG. 2 is another front view of a home cooking appliance with a side swing door having an integral friction based dampening hinge, in which the side swing door is open, according to an exemplary embodiment of the invention.

With reference to FIGS. 1 and 2, an exemplary embodiment of a home cooking appliance 100, such as a built-in oven or freestanding oven, will first be described.

As shown in FIG. 1, a home cooking appliance 100, such as a built-in oven or freestanding oven, can include one or more cooking cavities (shown in FIG. 2) accessible via a door 106. The door 106 can be a side swing door, such as a right-hand opening door or a left-hand opening door. The home cooking appliance may include a control panel 102 having a plurality of controls 104 for controlling an operation of the appliance. The door 106 can include a handle 108.

Figure 3:
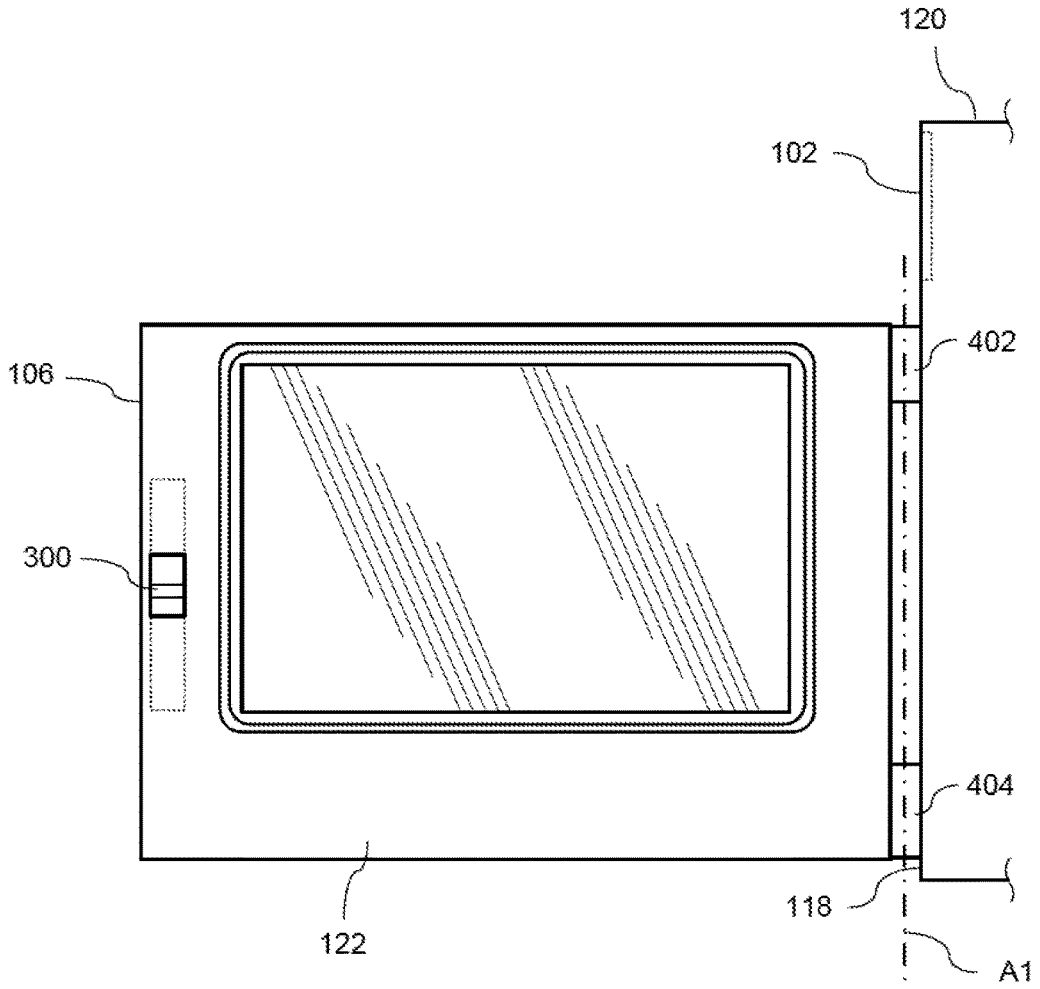
FIG. 3 is a plan view of a side swing door of a home cooking appliance with an integral friction based dampening hinge, according to an exemplary embodiment of the invention.

With reference to FIG. 2, the side swing door 106 can be movable about an upper hinge and a lower hinge (e.g., friction hinges 402, 404 as described in greater detail below) between a closed position and an open position to provide access to a cooking cavity 114. The cooking cavity 114 can include one or more racks or shelves 116 for supporting items to be cooked. The front 118 of the appliance chassis 120 or the inside of the door 106 can include means for sealing the door 106 to the chassis of the appliance 100, such as a temperature resistant seal 124. In the exemplary embodiment illustrated in FIG. 2, the cooking appliance 100 can include an integral self capturing latch having a stationary hook 200 mounted on the front 118 of the appliance chassis 120 and a receiver 300 on the door 106 that receives the stationary hook 200 when the door 106 is moved into the closed position. With reference to FIG. 3, an example of an interior of a side swing door 106 can include an interior surface 122 having a receiver 300 that receives the stationary hook 200 of the appliance 100 when the door 106 is moved into the closed position. The exemplary embodiments are not limited to an appliance having any particular arrangement of door swing, such as a right-hand opening door or left-hand opening door. For example, one or more appliances can be arranged alongside each other, or on top of each other. The doors of each of the appliances can open in the same direction or in opposite directions. The appliances can include control panels in the same position or in different positions. The controls of the control panel can be similar or identical, or have different arrangements. The doors each can include an integral self capturing latch having a stationary hook mounted on the front of the appliance chassis and a receiver on the door that receives the stationary hook when the door is moved into the closed position.

With reference to FIGS. 2-6, exemplary embodiments of a home cooking appliance 100 with a side swing door 106 having one or more friction hinges (e.g., 402, 404) will now be described. As explained above, the side swing door 106 can be movable, for example, about an upper hinge and a lower hinge (e.g., 402, 404) between a closed position and an open position to provide access to a cooking cavity 114, and any position in between. In the exemplary embodiment illustrated in FIGS. 2-6, the upper hinge 402 and a lower hinge 404 each comprise a friction hinge configured to impede rotational motion of the side swing door 106. However, in an alternative embodiment, only one of the hinges may comprise a friction hinge to impede rotational motion of the side swing door 106.

With reference again to the exemplary embodiments illustrated in FIGS. 2-6, the upper friction hinge 402 and the lower friction hinge 404 each can include a fixed axis, and more particularly, a fixed vertical axis A1. However, in other embodiments, one or more of the friction hinges 402, 404 can include a plurality of axes using multiple linkages. The friction hinges 402, 404 are schematically illustrated and not limited to the illustrated arrangements. One of ordinary skill in the art will recognize that other types of friction hinges can be provided, and the present invention is not limited to any particular type of friction hinge.

Figure 4:
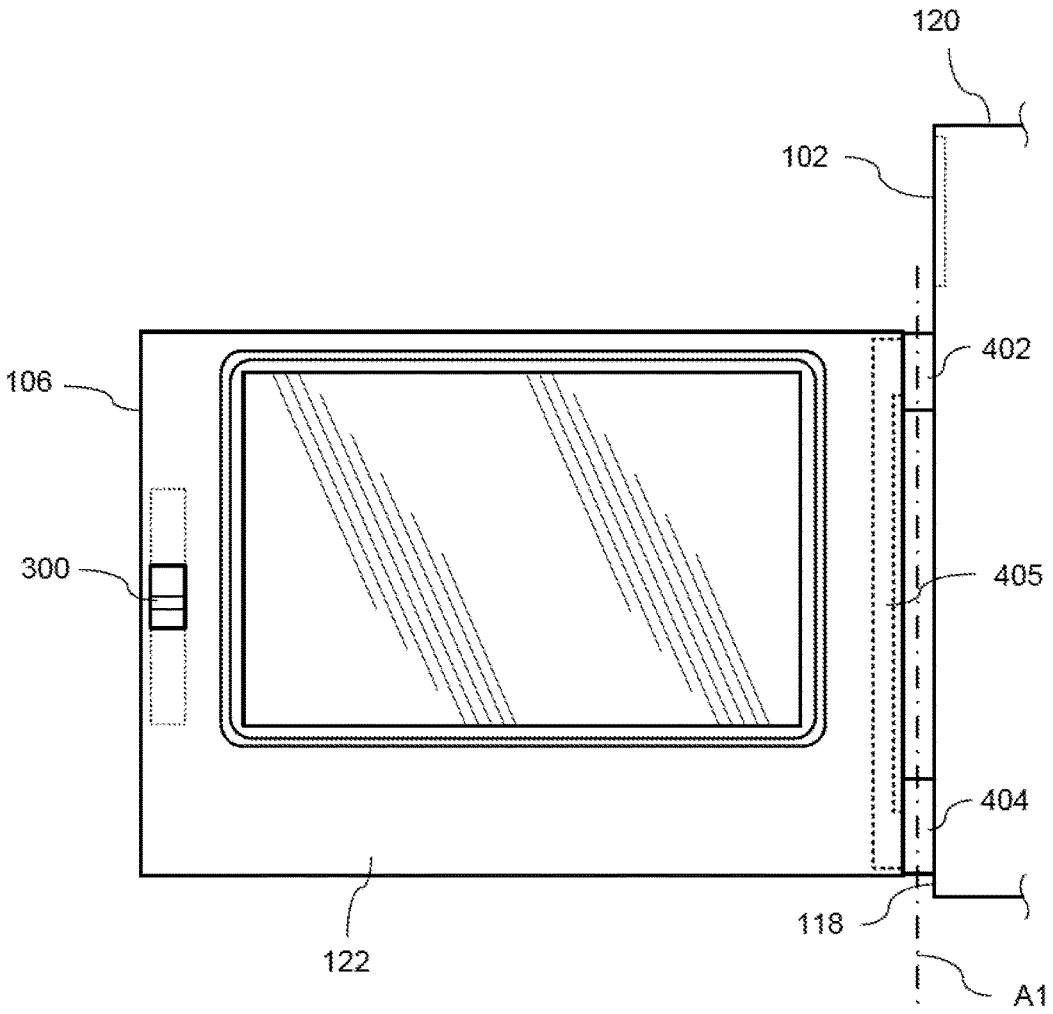
FIG. 4 is a plan view of a side swing door of a home cooking appliance with an integral friction based dampening hinge, according to another exemplary embodiment of the invention.

The one or more friction hinges 402, 404 can be disposed at various locations on the side swing door 106, such as at or adjacent to an upper edge and a lower edge of the side swing door 106 as shown in FIGS. 2-4, at a position along the side edge of the side swing door 106 and a distance from the upper and lower edges, or at other suitable locations on the side swing door 106. The side swing door 106 can include one or more openings or mounting areas for receiving the one or more friction hinges 402, 404. The exemplary embodiments of the home cooking appliance can be configured such that the friction hinge 402, 404 fits within a limited available space inside the door frame of the side swing door 106, and particularly, within the limited available space inside the door frame at the particular hinge location. The housing 120 can include a mounting bracket that receives a part of the friction hinges 402, 404 to secure the side swing door 106 to the housing 120. In other embodiments, the housing 120 of the home cooking appliance 100 can include an opening and/or a mounting surface that receives a part of the friction hinges 402, 404 to secure the side swing door 106 to the housing 120. In other embodiments, the friction hinges 402, 404, or a part of the friction hinges 402, 404, can be coupled to or integrally formed with the housing 120 of the home cooking appliance 100.

As shown in FIG. 3, the friction hinges 402, 404 can be separately coupled to the frame of the door 106. In another exemplary embodiment, as shown in FIG. 4, the friction hinges 402, 404 can be coupled together by a connecting bar, frame, or the like 405, which may be disposed within the door 106. The friction hinges 402, 404 can be configured such that some or all of the components of the friction hinges are formed from materials that are capable of withstanding elevated temperatures of a home cooking appliance, such as temperatures ranging from approximately 90° C.-100° C.

Figure 5:
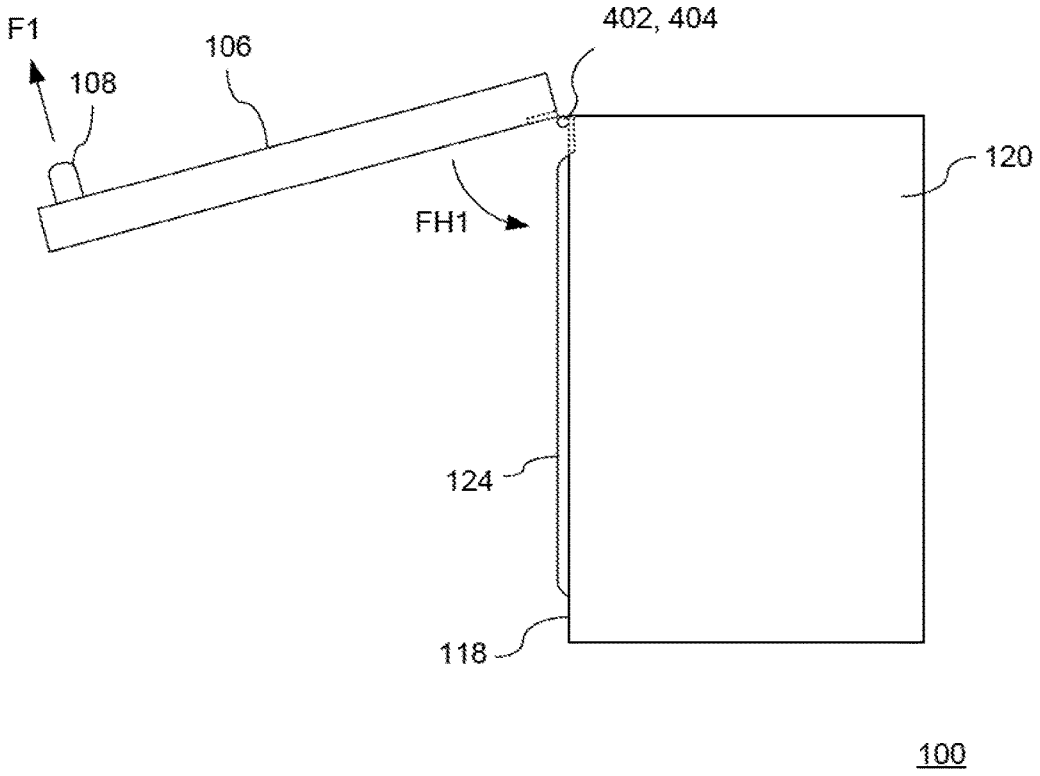
FIG. 5 is a schematic, top view of a home cooking appliance with a side swing door having an integral friction hinge, in which the side swing door is open, according to an exemplary embodiment of the invention.
Figure 6:
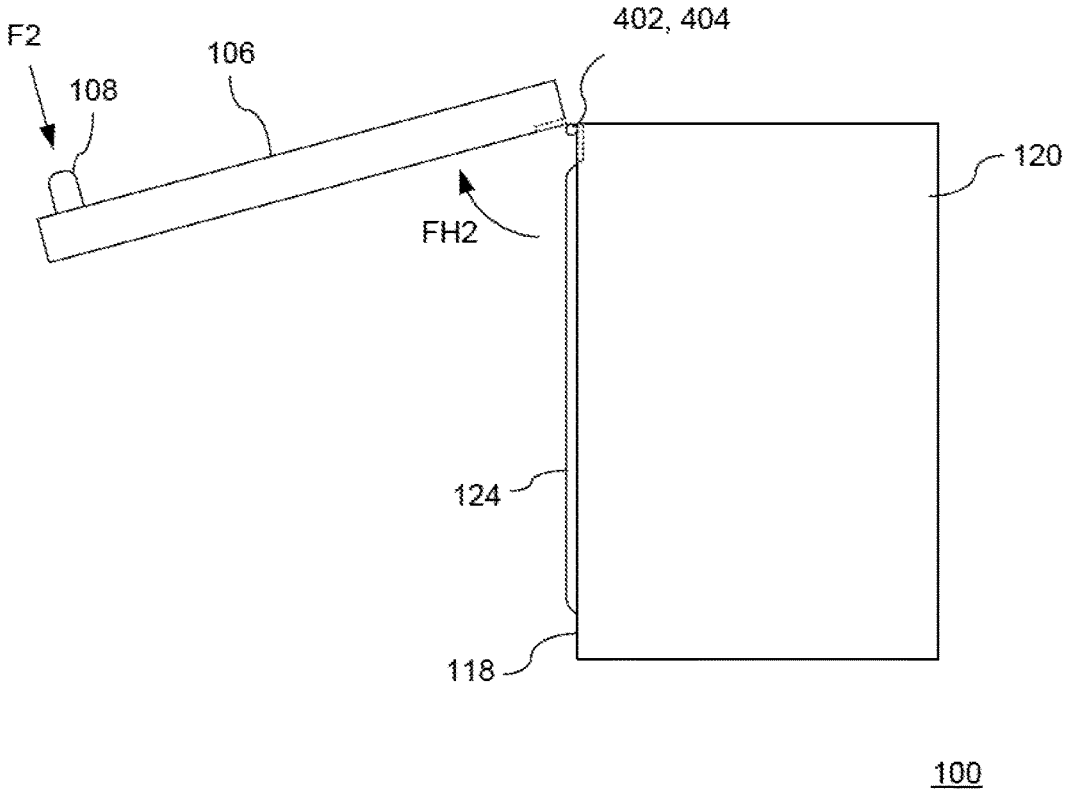
FIG. 6 is another schematic, top view of a home cooking appliance with a side swing door having an integral friction hinge, in which the side swing door is open, according to an exemplary embodiment of the invention.

With reference to FIGS. 5 and 6, an example of the operation of a side swing door 106 having one or more friction hinges 402, 404 will now be described. In operation, a user may apply a force F1 to the handle 108 of the side swing door 106 to impart an opening movement of the door 106 about the friction hinges 402, 404. The exemplary friction hinge 402, 404 can be configured to provide a torque FH1 in an opposite direction to the force F1 to resist the rotational opening motion and provide a tactile feel to the opening operation of the door 106. When the user discontinues the force F1, the torque FH1 exerted by the friction hinge 402, 404 can act as a braking force to prevent the door 106 from rotating or continuing to rotate about the axis of the hinges 402, 404 in the opening direction, thereby enabling the door to be precisely positioned by the user. Additionally, in the event that the side swing door 106 is inadvertently bumped or impacted by the user or another person in the opening direction, the torque FH1 exerted by the friction hinge 402, 404 can impede or resist any rotational motion of the side swing door 106 to quickly slow and stop the unintended motion of the side swing door 106.

In operation, when a user applies a force F2 to the handle 108 of the side swing door 106 to impart a closing movement of the door 106 about the friction hinges 402, 404, the exemplary friction hinge 402, 404 provides a torque FH2 in an opposite direction to the closing force F2, as well as opposite to the torque FH1, to resist a rotational closing motion and provide a tactile feel to the closing operation of the door 106. When the user discontinues the force F2, the torque FH2 exerted by the friction hinge 402, 404 can act as a braking force to prevent the door 106 from rotating or continuing to rotate about the axis of the hinges 402, 404 in the closing direction. Additionally, in the event that the side swing door 106 is inadvertently bumped or impacted by the user or another person in the closing direction, the torque FH2 exerted by the friction hinge 402, 404 can impede or resist the rotational motion of the side swing door 106 to quickly slow and stop the side swing door 106.

Similarly, in operation, if an external force (e.g., F1, F2) is applied to the side swing door 106, for example resulting from a user pushing the side swing door or bumping into the side swing door 106 while the door 106 is in a partially open position, the exemplary friction hinge 402, 404 provides a respective torque (e.g., FH1, FH2) in an opposite direction to the respective force (e.g., F1, F2) to resist a rotational motion and provide a tactile feel to the operation of the door 106. When the user discontinues the force (e.g., F1, F2), the torque (e.g., FH1, FH2) exerted by the friction hinge 402, 404 can act as a braking force to prevent the door 106 from rotating or continuing to rotate about the axis of the hinges 402, 404.

With reference again to FIGS. 2-6, in an exemplary embodiment, one or more of the friction hinges 402, 404 can include a constant torque friction hinge, which provides constant torque throughout the entire range of motion in one or more of the opening direction and the closing direction.

In another exemplary embodiment, one or more of the friction hinges 402, 404 can provide different resistive forces (e.g., torque FH1, FH2) to rotation of the door depending on a direction of rotation initiated by the user. For example, one or more of the friction hinges 402, 404 can be configured such that a resistance (e.g., torque FH1) to rotation while opening the door (e.g., in a first direction) is less than a resistance (e.g., torque FH2) to rotation when closing the door (e.g., in a second direction, which is opposite the first direction), or vice versa, depending upon the tactile experience that is intended to be perceived by the user. For example, one or more of the friction hinges 402, 404 can be configured such that a differential torque is 100% of nominal torque in the first direction and 65% of nominal torque in the second (opposite) direction.

In another exemplary embodiment, one or more of the friction hinges 402, 404 can include a variable torque friction hinge, which provides varying torque throughout the range of motion in one or both of the opening direction and the closing direction. For example, a dynamic torque of one or more of the friction hinges 402, 404, which is defined as a resistance experienced during rotation of the hinge, can be configured to be different from (e.g., less than) a static torque of the one or more of the friction hinges 402, 404, which is the resistance required to start the rotation of the door 106 about the friction hinges 402, 404.

In another exemplary embodiment, one or more of the friction hinges 402, 404 can provide varying amounts of so-called spring back, which is defined as the amount of motion (in degrees) that results after a force (e.g., F1, F2) applied to the side swing door 106 to move the door 106 is removed. In another exemplary embodiment, one or more of the friction hinges 402, 404 can provide varying amounts of so-called free play, which is defined as the amount of motion (in degrees) that the side swing door 106 is permitted to move before a user perceives a torque (e.g., FH1, FH2) at a given position of the hinges 402, 404. In another exemplary embodiment, one or more of the friction hinges 402, 404 can be configured to minimize or eliminate so-called spring back altogether, thereby providing a more precise positioning of the door 106 with minimal or no additional movement after the user releases the door 106 or ceases to apply force to the door 106. Similarly, in another exemplary embodiment, one or more of the friction hinges 402, 404 can be configured to minimize or eliminate so-called free play altogether, thereby providing a more precise positioning of the door 106 and an improved, and more responsive, tactile feel to the user when the user begins moving the side swing door 106.

Figure 7:
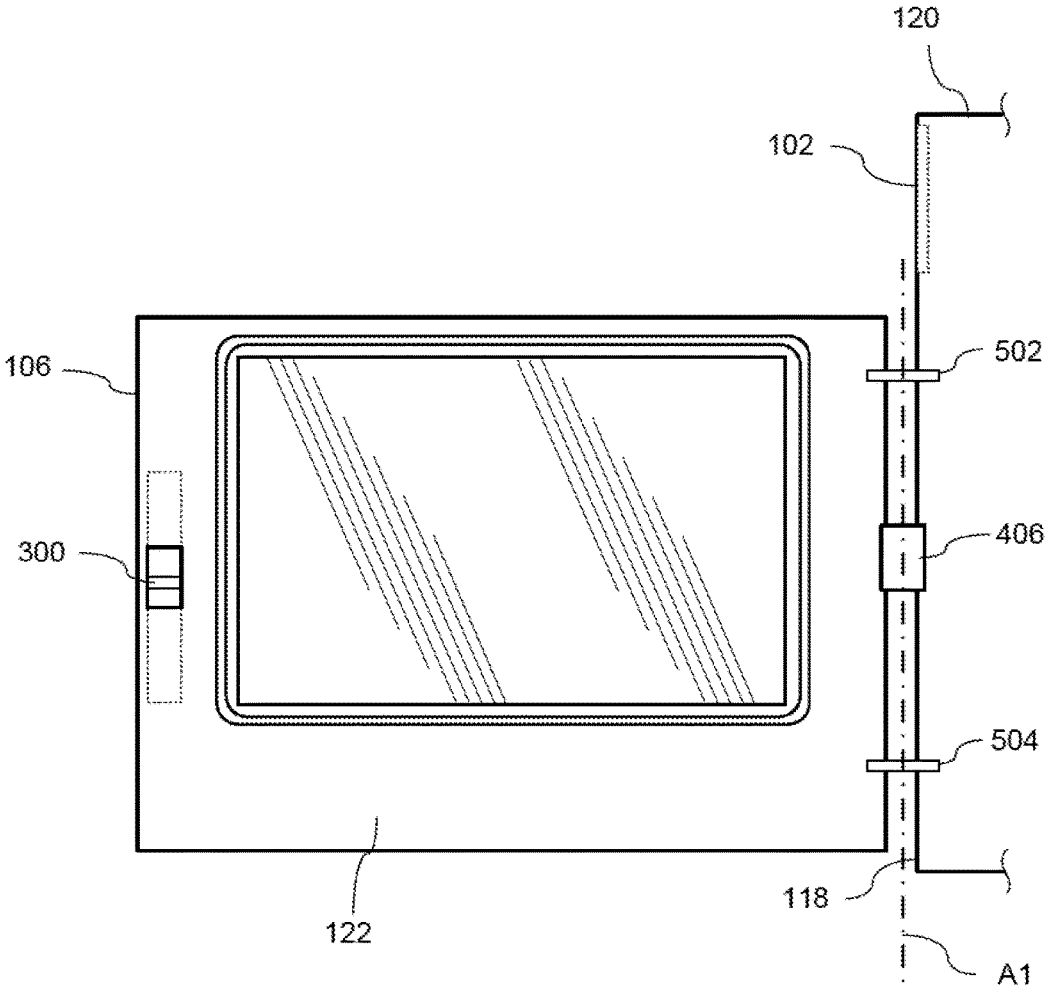
FIG. 7 is a plan view of a side swing door of a home cooking appliance with an integral friction based dampening hinge, according to another exemplary embodiment of the invention.

With reference to FIG. 7, in another exemplary embodiment, a home cooking appliance 100 with a side swing door 106 alternatively can include one or more low friction upper and lower hinges 502, 504 to rotatably support the side swing door 106 on the appliance 100, along with one or more additional friction hinges 406 configured to impede rotational motion of the side swing door 106 and provide a desired tactile feel to a user.

Figure 8:
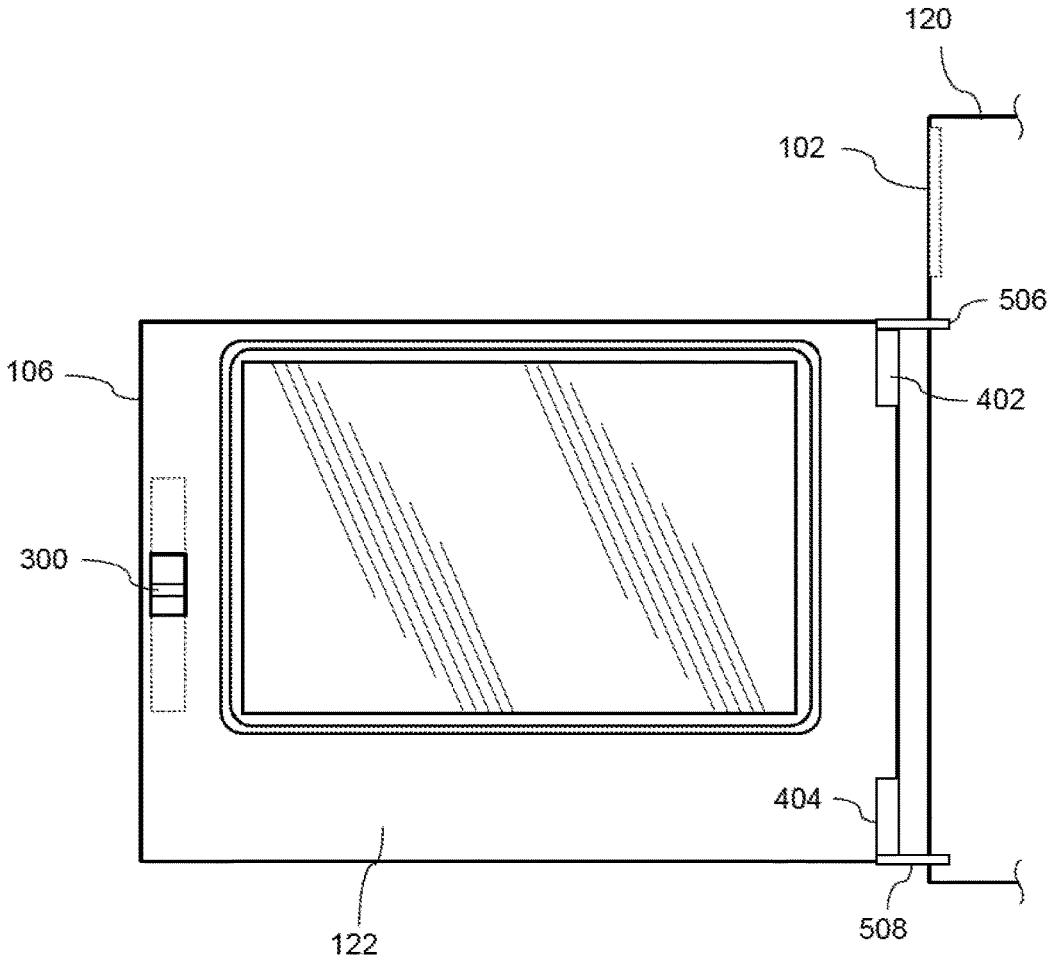
FIG. 8 is a plan view of a side swing door of a home cooking appliance with an integral friction based dampening hinge, according to another exemplary embodiment of the invention.

With reference to FIG. 8, in another exemplary embodiment, a home cooking appliance 100 with a side swing door 106 can include one or more friction hinges 402, 404 that are integrally formed with an alternative type of hinge 506, 508. For example, the alternative type of hinge 506, 508 can be configured to provide a desired tactile feel to the user by, for example, utilizing gravitational assist or utilizing another additional device that provides mechanical assistance, such as for example springs, magnets, or another device, in order to support the side swing door while impeding the motion of the side swing door and providing a particular, tailored tactile force.

Figure 9:
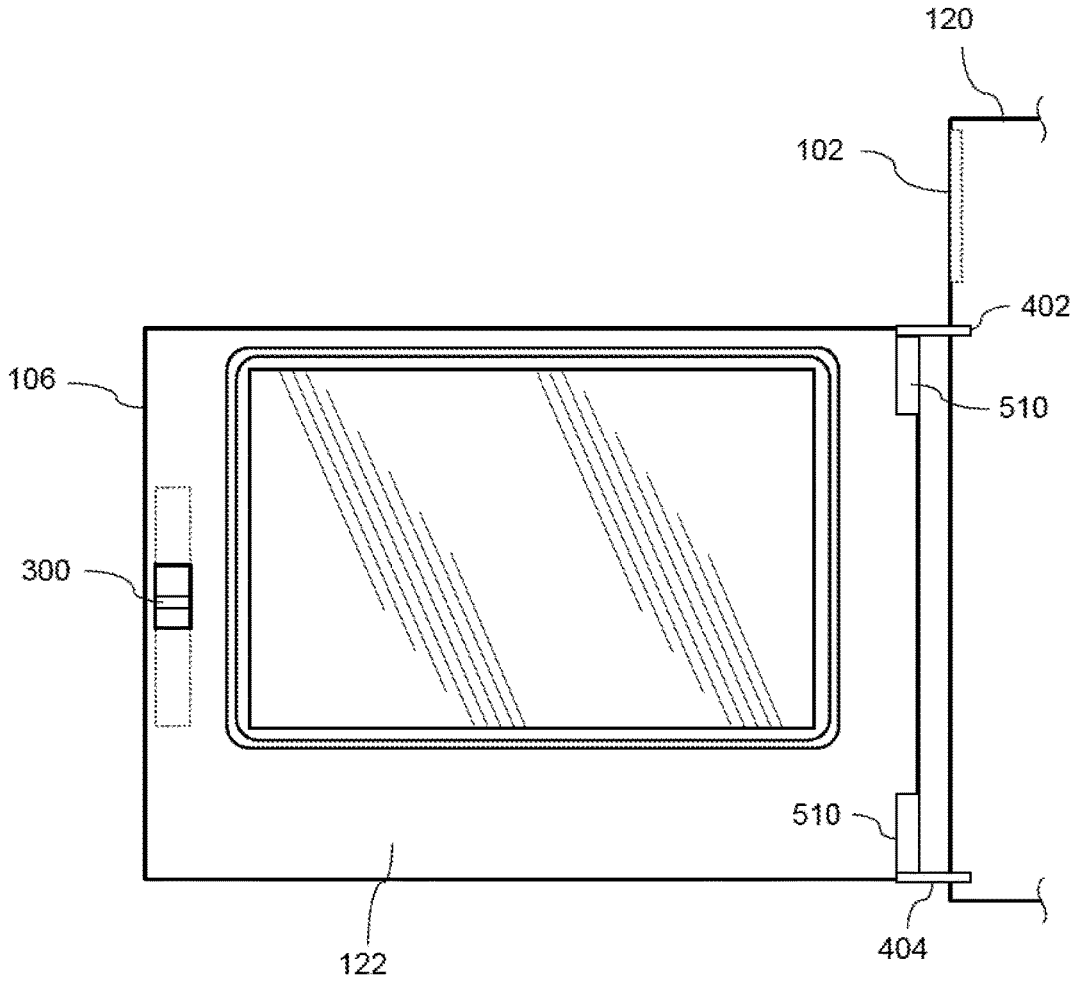
FIG. 9 is a plan view of a side swing door of a home cooking appliance with an integral friction based dampening hinge, according to another exemplary embodiment of the invention.
Figure 10:
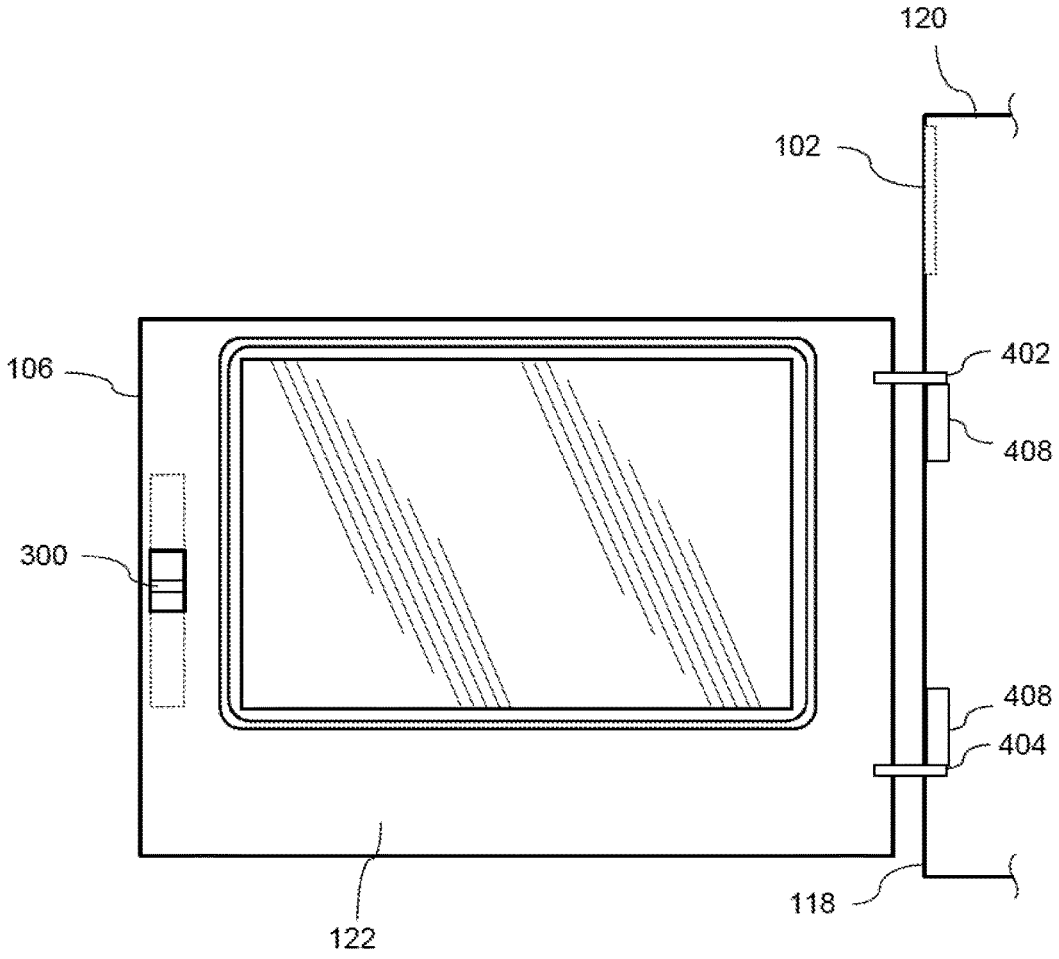
FIG. 10 is a plan view of a side swing door of a home cooking appliance with an integral friction based dampening hinge, according to another exemplary embodiment of the invention.

With reference to FIG. 9, in another exemplary embodiment, a home cooking appliance 100 with a side swing door 106 having one or more of the friction hinges 402, 404 additionally can include a device 510 that, for example, utilizes gravitational assist or provides mechanical assistance, such as for example springs, magnets, or another device, in order to provide a particular, tailored tactile force while minimizing or reducing a risk of injury to a user of the home cooking appliance 100. The device 510 can be coupled to at least one of the side swing door 106, as exemplarily illustrated in FIG. 9, and the housing 120, as exemplarily illustrated in FIG. 10. In the exemplary embodiment, the tactile forces on the side swing door 106 may be augmented or reduced by a combination of gravity assist and/or another mechanical means provided by the additional device 510, while the friction hinges 402, 404 provide the primary function of impeding the motion of the side swing door 106. One of ordinary skill in the art will recognize that various devices 510 are known for imparting a gravitational force or a mechanical force on the side swing door 106. FIGS. 9 and 10 schematically illustrate the friction hinges 402, 404 at various locations. As explained above, the one or more friction hinges 402, 404 can be disposed at various locations on the side swing door 106.

With reference again to FIGS. 2-10, in yet another exemplary embodiment, one or more of the friction hinges 402, 404, 406 can be configured to apply a predetermined amount of closing force and/or a predetermined amount of opening force to the side swing door 106. The predetermined amount of closing force can be equal to the predetermined amount of opening force, or the predetermined amount of closing force can be different from, or independent of, the predetermined amount of opening force. In this way, the present invention can provide a tailored tactile feel which may also maintain or improve a level of safety to the user of the home cooking appliance. Depending on the amount of closing force provided by the one or more of the friction hinges (e.g., 402, 404, 406), the present invention also may minimize an amount of latching force needed to secure the side swing door 106 in a closed position, or eliminate the need to provide a latching mechanism altogether. The home cooking appliance 100 with a side swing door 106 can include one or more friction hinges 402, 404 that are integrally formed with another type of hinge (e.g., 502, 504, 506, 508, and/or 510) that is configured to provide the predetermined amount of closing force and/or the predetermined amount of opening force, or the home cooking appliance 100 can include one or more separate friction hinges (e.g., 402, 404, 406) along with one or more of another type of hinge (e.g., 502, 504, 506, 508, and/or 510) that is configured to provide the predetermined amount of closing force and/or the predetermined amount of opening force to the side swing door 106.

The exemplary embodiments of the present invention can be configured such that one or more, or all, of the components of the integrated friction based hinge are formed from, coated by, or protected by, a material that can withstand a range of elevated temperatures of, for example, 90° C.-100° C.

One of ordinary skill in the art will recognize that the friction hinge can be configured to provide one of more of the aforementioned functions and the example friction hinges are not limited to any particular arrangement of function.

To summarize, an exemplary embodiment is directed to a home cooking appliance (e.g., 100) comprising a housing (e.g., 120) having a cooking cavity (e.g., 114), and a side swing door (e.g., 106) movable about at least one hinge (e.g., 402, 404, 406) between a closed position and an open position to provide access to the cooking cavity, wherein the at least one hinge includes a friction hinge (e.g., 402, 404, 406) configured to impede rotational motion of the side swing door (e.g., 106).

Another exemplary embodiment is directed to a home cooking appliance (e.g., 100) comprising a housing (e.g., 120) having a cooking cavity (e.g., 114), a side swing door (e.g., 106) movable about at least one hinge (e.g., 402, 404, 406) between a closed position and an open position to provide access to the cooking cavity, and means (e.g., friction hinge 402, 404, and/or 406) for impeding rotational motion of the side swing door (e.g., 106).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a cooking cavity; and a side swing door movable about at least one hinge between a closed position and an open position to provide access to the cooking cavity, wherein the at least one hinge includes a friction hinge configured to impede rotational motion of the side swing door, wherein the friction hinge is a variable torque friction hinge configured to provide a variable torque throughout at least a part of a range of motion in at least one of an opening direction and a closing direction of the of the side swing door, such that no detents are required and a tactile perception of the side swing door by a user is enhanced, while improving safety of the side swing door.

2. The home cooking appliance of claim 1, wherein the friction hinge is a variable torque friction hinge configured to provide a first variable torque throughout at least a part of a first range of motion in an opening direction and a second variable torque throughout at least a part of a second range of motion in a closing direction of the side swing door, and wherein the first variable torque is different than the second variable torque.

3. A home cooking appliance comprising:

a housing having a cooking cavity; and a side swing door movable about at least one hinge between a closed position and an open position to provide access to the cooking cavity, wherein the at least one hinge includes a friction hinge configured to impede rotational motion of the side swing door, wherein the friction hinge is configured to provide a first torque during a commencement of rotation of the side swing door from a resting position, wherein the friction hinge is configured to provide a second torque during the rotation of the side swing door, and wherein the first torque is different than the second torque, such that no detents are required and a tactile perception of the side swing door by a user is enhanced, while improving safety of the side swing door.

4. A home cooking appliance comprising:

a housing having a cooking cavity; and a side swing door movable about at least one hinge between a closed position and an open position to provide access to the cooking cavity, wherein the at least one hinge includes a friction hinge configured to impede rotational motion of the side swing door, wherein the friction hinge is configured to provide a predetermined amount of free motion of the side swing door about the friction hinge in a first direction after an external force is applied to the side swing door before the friction hinge provides a torque in a second direction that is opposite to the first direction, such that no detents are required and a tactile perception of the side swing door by a user is enhanced, while improving safety of the side swing door.

5. The home cooking appliance of claim 4, wherein the predetermined amount of free motion of the side swing door about the friction hinge in a first direction continues for a time after the external force applied to the side swing door is removed before the friction hinge provides a torque in a second direction that is opposite to the first direction.

* * * * *